United States Patent [19]

Pajevic

[11] Patent Number: 4,485,971

[45] Date of Patent: Dec. 4, 1984

[54] LIQUID SPRAYER

[76] Inventor: Paul D Pajevic, 220 Gateway Rd., Bensenville, Ill. 60106

[21] Appl. No.: 365,255

[22] Filed: Apr. 5, 1982

[51] Int. Cl.[3] ..... B05B 15/00

[52] U.S. Cl. ..... 239/289; 239/375; 222/383

[58] Field of Search ..... 239/289, 373, 375, 346, 239/353, 357, 355, 361; 401/27, 138, 137, 148, 146, 264; 294/1 BA; 222/373, 383, 384, 380, 381, 473, 474

[56] References Cited

U.S. PATENT DOCUMENTS

| | | | |
|---|---|---|---|
| Re. 22,045 | 3/1942 | Towart, Jr. | 222/473 X |
| 1,122,710 | 12/1914 | Feit | 222/384 X |
| 1,550,362 | 8/1925 | Janer | 239/373 X |
| 1,742,604 | 1/1930 | Lemoine | 239/373 X |
| 2,508,104 | 5/1950 | Dickensheets | 239/274 X |
| 2,553,040 | 5/1951 | Greene | 239/373 |
| 3,471,065 | 10/1969 | Malone | 239/373 X |
| 4,383,710 | 5/1983 | Fehr | 294/1 BA |

FOREIGN PATENT DOCUMENTS

| | | | |
|---|---|---|---|
| 0029256 | 3/1907 | Austria | 222/383 |
| 0638508 | 5/1928 | France | 239/357 |

*Primary Examiner*—Andres Kashnikov
*Assistant Examiner*—Mary F. McCarthy
*Attorney, Agent, or Firm*—Harvey B. Jacobson

[57] ABSTRACT

A liquid sprayer to assist in disposal of animal excrement and characterized so that the sprayer may be carried as a walking cane, the liquid sprayer consisting primarily of two axially aligned, concentric chambers, one acting as a pressurized water reservoir communicated by a spring-biased ball valve with the other chamber which is an air chamber, the pressurized water reservoir fitting into the other chamber and acting as an air pump which pumps air through the ball valve into the water reservoir when the air chamber is compressed. The top chamber which is the water reservoir has a handle attached to its top which is attached to an airtight brass end plug retaining the water and air of the water reservoir under pressure until the handle release lever and discharge valve are actuated for releasing water under pressure driven by the air through a nozzle, the nozzle directing the water upon animal excrement, the liquid sprayer performing an appropriate method of removing, cleaning up and rendering animal defecation unobjectionable and diffused.

6 Claims, 6 Drawing Figures

100
96
130

80
140
90
92
82
5
140
98
12
74
72
76
94
86
88
84
78
70
108
36
34
104
10
5
16
14
60
106
120
110
126
128
122

60
44
46
32
28
26
30
62
64
66
42
40
24
18
54
56
52
50
58
20
22
59

LIQUID SPRAYER

BACKGROUND OF THE INVENTION

The present invention relates to a hand-carried pressurized water reservoir, an air pump directing air into the water reservoir, and an airtight release lever on a handle for allowing spray from the water reservoir to be directed to animal excretions for their ultimate diffusion and disposition.

More particularly the invention relates to providing such pressurized water reservoir for fitting into an air chamber for use as an air pump and directing air from the air chamber into the water reservoir through a biased ball valve member, a rubber bumper provided on the ground-engaging portion of the liquid sprayer assembly, and a handle at the other end for being carried such that release of a lever on the handle provides pressurized water spray upon animal excrement for its ultimate disposition and disposal. An air intake ball valve, also which may be spring-biased, is provided in the air chamber for intake of air which is compressed and discharged into the water reservoir through an outlet ball valve. The water is directed through a nozzle when the handle lever actuated valve is released so that the water is directed onto the animal excrement, the nozzle being mounted on the side of the pressurized water reservoir and being inclined generally away from the reservoir for directing the resultant water spray to the proximate location of the animal excrement being diffused or dispersed.

FIELD OF THE INVENTION

At the present time it has become well recognized in urban and suburban areas that appropriate method and apparatus must be provided for attending to the presence of animai defecation or excrement in public areas, sidewalks, lawns, and areas proximate streets and roadways. While many cities and other jurisdictions, whether large or small, have enacted laws making it mandatory for the owner of an animal to clean up the animal's defecated matter and excrement, there are times that this should be done with greater effectiveness. There is the desirability of breaking up freshly defecated animal matter with water under pressure rather than having it mechanically picked up, bagging it and later disposing of it where it again may present the same problem as initially defined. The concept of the present invention is in the desirability of using a unique device so that the animal defecated or fecal matter is mechanically broken down for assimilation into the environment or is disposed of easier than where the animal defecated matter is not attended to. The present invention has provided an appropriate method of removing, cleaning up or rendering innocuous and unobjectionable such animal defecated matter not heretofore known in terms of the prior art.

DESCRIPTION OF PRIOR ART

Various prior art U.S. patents disclose various pumping and spraying devices and they are as follows: U.S. Pat. Nos. 2,514,516; R. R. Root; 2,911,157; S. Converse; 3,265,308; H. W. Hopkins; 4,117,555; B. E. Dennis; 4,192,464; H. Chow; 4,193,517; W. N. Felty, et al.

These patents disclose pumping devices used for selectively spraying water or other fluid or liquid materials, but none of these patents are directed to such arrangements including a ground contacting reciprocable plunger which effects an air pressure buildup within a water chamber releasable by a lever on the handle and for directing water under pressure to animal defacated or fecal matter. None of these prior art disclosures bear upon the patentability of any claim of the present invention.

SUMMARY OF THE INVENTION

An object of the present invention is to provide a manual, convenient to operate and convenient to carry liquid sprayer device which is easy to use and useful in disposing of small animal excretions, animal defecated matter and which is easily carried and includes a liquid sprayer containing a water reservoir, another chamber useful in compressing air for insertion into the water reservoir, a bumper of elastomeric material disposed between the air pump and a sidewalk or ground engagement surface, a handle on the other end secured to the water reservoir and having on the handle a pivoted release mechanism for releasing water under pressure with the water being directed through a nozzle, the nozzle directing the water under pressure to the animal excrement to be rendered diffused and innocuous to the surrounding environment.

A further and additional object and feature of the present invention is to provide an arrangement consisting primarily of two concentric telescopic tubes, an upper tube acting as a pressurized water reservoir and fitting into the lower tube acting as the air pump. The upper tube is affixed to a handle attached to the top of a brass valve body which is attached to the airtight brass end plug and the handle also incorporates a spray release lever for directing the water under pressure to break-up animal defecated or fecal matter. The entire device according to the invention resembles a walking cane of a slightly larger diameter and of a small increase in weight primarily due to the reservoir containing the water which is to be sprayed from the apparatus.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 5:
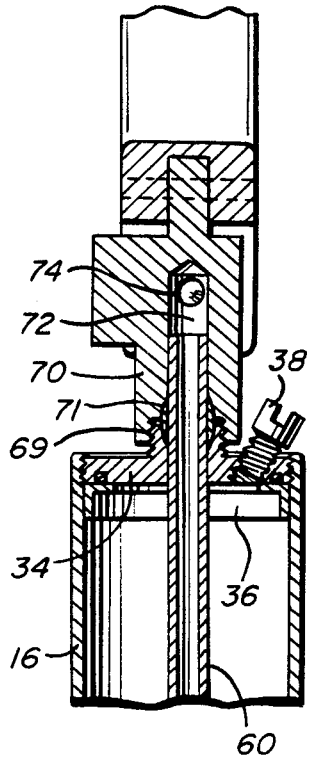
FIG. 5 is a sectional view taken along line 5—5 of FIG. 3.
Figure 6:
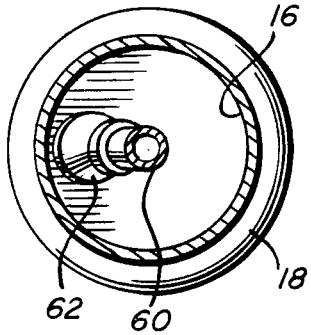
FIG. 6 is a plan view of the arrangement shown in FIG. 4.

Referring now to the drawing there is shown a liquid sprayer assembly 10 having component parts including a die cast or plastic handle 12, a pressurized water reservoir 14 including a tubular cylinder 16, an air pump 18 in telescopic relation with the tubular cylinder 16 and an end 20 including a rubber or elastomeric bumper 22 for engaging a sidewalk or ground surface 23. The tubular cylinder 16 is constructed to possess a watertight integrity throughout its interior and has a bottom cover or plate 24 with a centrally positioned ball check valve 26 of conventional construction including an axial passageway 28, a ball 30, a spring 32 and arranged for the ingress of air from the air pump 18. At the other end of the tubular cylinder 16 there is a closure plate 34 together with a seal flanged member 36 which may be brazed or welded in place. A pressure-tight water filler plug 38 shown in FIG. 5 may be threadedly removed so that the water reservoir 14 may be accordingly filled with water and then the plug 38 is inserted to close the plate 34 and maintain the watertight integrity of the water reservoir 14.

The air pump 18 is of generally cylindrical construction and as referred to above, is in telescopic relation with the tubular cylinder 16. The plate 24 of the water reservoir has an extension or annular abutment 40 for engaging with a smaller diameter annular member 42 of the air pump so that telescopic relationship of the parts 16–18 is maintained, and for preserving a degree of airtight integrity, the wall of the air pump extends upwardly to terminate at the cylindrical portion 44 wherein there are a set of O-rings 46 for maintaining the airtightness. At the other end of the air pump 18 there is a closure or plate 50 which may be of a general conic or convex structure for closing the lower end of the air pump 18 in which there is centrally disposed along an axis of the air pump an air ball check valve 52 having similar components including the ball, the spring, the axial passage similar to the ball check valve 26. The interior space 54 of the air pump is provided with a helical or preferably a conical spring element 56 that is arranged to urge the elements 24, 50 apart in the axial orientation. The air ball check valve 52 receives air from the exterior of the air pump through an air passageway 58 into an axial chamber space 59, and when the air pump 18 is in its expansion mode due to the spring 56 having been compressed and thereupon released, air is then drawn through the passageway 58 through the air ball check valve 52 and thence into the interior 54 of the air pump 18 and is collected there through the entire expansion mode of the air pump. At the end of the expansion mode, the air ball check valve 52 is thereupon closed and ball check valve 26 having been closed will not open until the air pump 18 is caused to go into its compression mode, the air ball check valve 52 maintaining its closed state while the ball check valve 26 is opened for ingress of air into the water reservoir 14 until the completion of the compression mode of the air pump 18. At the end of this mode of compression, or repetitive stages of such compression mode, air and water within the water reservoir achieve a pressure in excess of the exterior atmospheric and normal pressure conditions, air collecting to the top of the tubular cylinder 16 while water resides at the bottom in the usual manner, the tubular cylinder 16 maintaining its air and watertight integrity.

Figure 3:
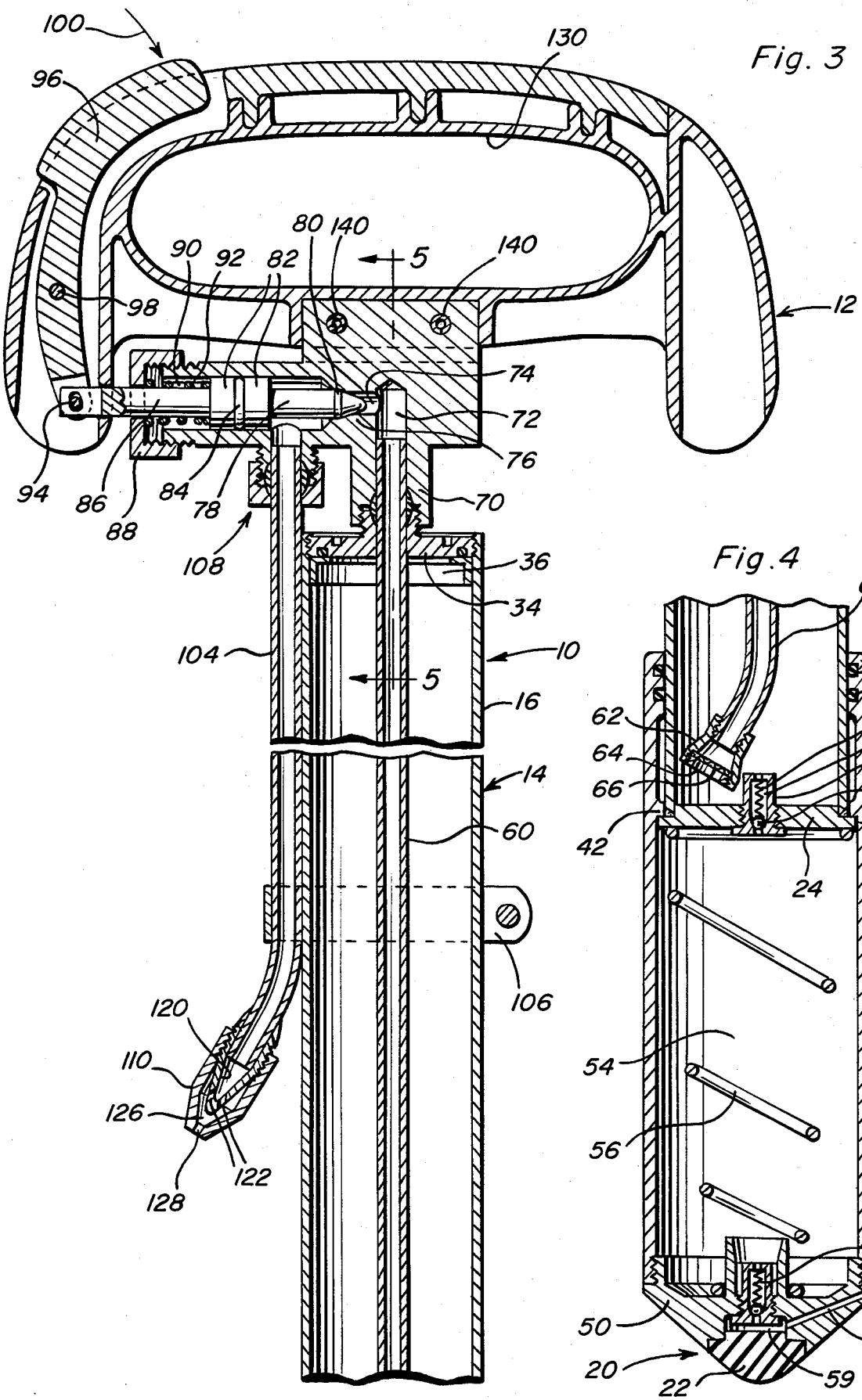
FIG. 3 is an enlarged sectional view of the upper portion of the liquid sprayer taken along line 3—3 of FIG. 2.
Figure 4:
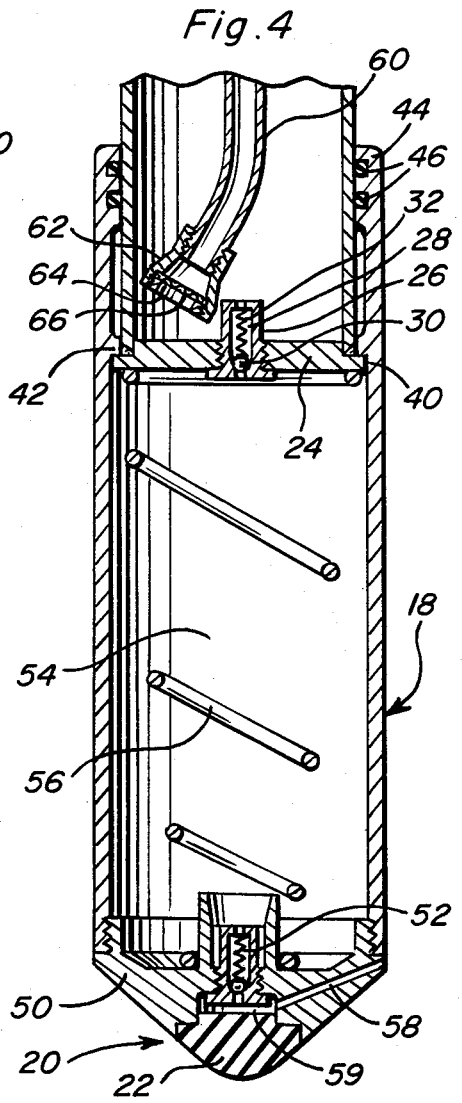
FIG. 4 is an enlarged sectional view of the lower portion of the liquid sprayer taken along line 4—4 of FIG. 3.

Passing centrally through almost the entire length of the tubular cylinder 16 is a small water exit copper tubing 60 shown in FIGS. 3–6, the lower end thereof being axially offset and for receiving in mounting relation thereon a water intake element 62 and having across the opening orifice 64 thereof a screen 66 to filter out foreign particles. The other end of the copper tubing 60 passes axially through the plate 34 and through a handle neck member 70 screw threaded at 69 to plate 34 with a brass compression fitting 71 to securely mount and seal tubing 60. As shown in FIG. 3, tubing 60 communicates beyond its end with a cavity 72 which in turn communicates with a radial cavity 74 closed by valve body 76 engaging with a valve member 78 having an O-ring 80 to seal off and positively close the valve body 76 and the valve member 78 when in their closed condition. The valve member 78 is coupled axially onto a valve stem 82 also having an O-ring 84, the valve stem coupled to a valve rod 86 extending through a closure cap 88 and closing a space 90 containing a stainless steel compression spring 92 that urges the valve member 78 to closed condition as shown in FIG. 3. The valve rod 86 is connected by a pivot pin 94 to a release lever 96 which is similarly pivotally mounted on handle 12 at pivot pin 98, so that depression of the release lever by one's thumb or hand at the free end of the lever 96 shown at arrow 100, the valve 78 will open and release water to pass through the copper tubing 60 from the bottom of the water reservoir 16 due to the force of compressed air within the tubular cylinder 16, so that the water is forced through the valve and down copper tubing 104 under pressure at sufficient velocity to traverse the nozzle 110 and direct a water spray 112 to animal defecated or fecal matter shown in FIG. 1 as having been diffused and and broken up at 114, rendering the animal defecation material unobjectionable, broken up, so that there has been achieved a renewed sanitary environment and by use of the liquid sprayer assembly, there is no additional or further clean-up after use of the liquid sprayer assembly 10. It is noted that various forms of the nozzle construction may be used but maximum directed water flow under air pressure conditions is achieved where there is an interior nozzle body 120 having outwardly directed openings 122 about the tip of the interior nozzle body 120 and there is the additional nozzle cavity 126, the pressure continuing the water flow through this cavity 126 through the opening 128 for providing the directed water under force jet spray by the head of the nozzle 110.

Figure 1:
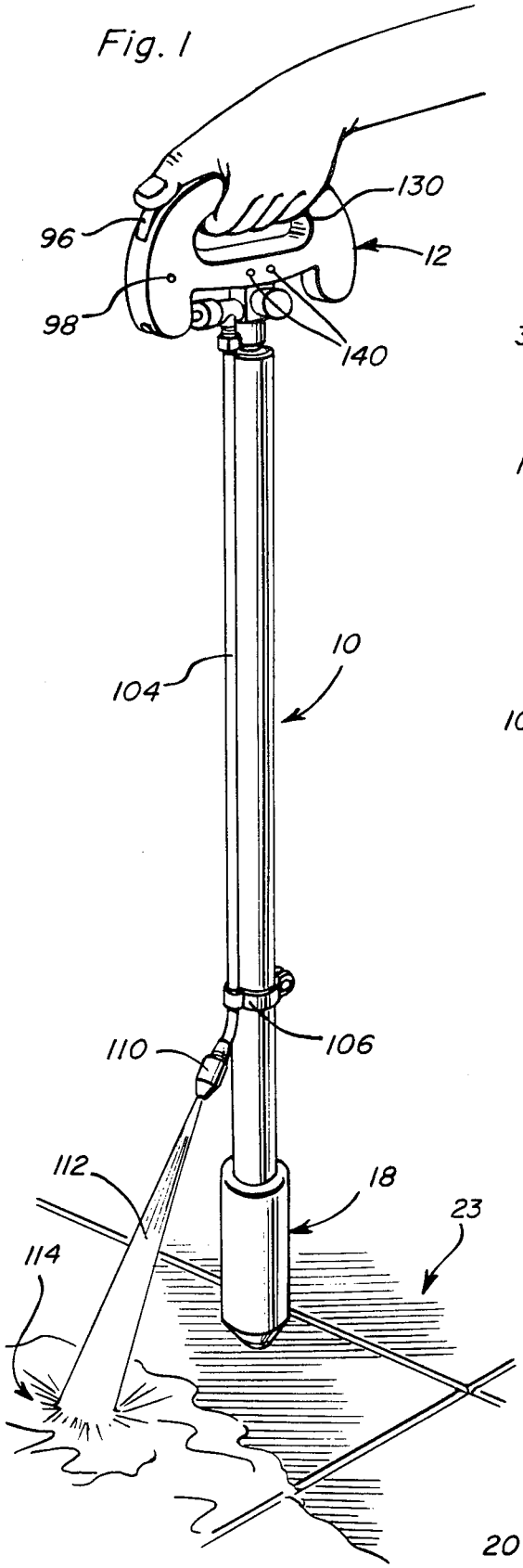
FIG. 1 is a perspective view of a liquid sprayer and walking cane configuration according to a preferred embodiment of the present invention.
Figure 2:
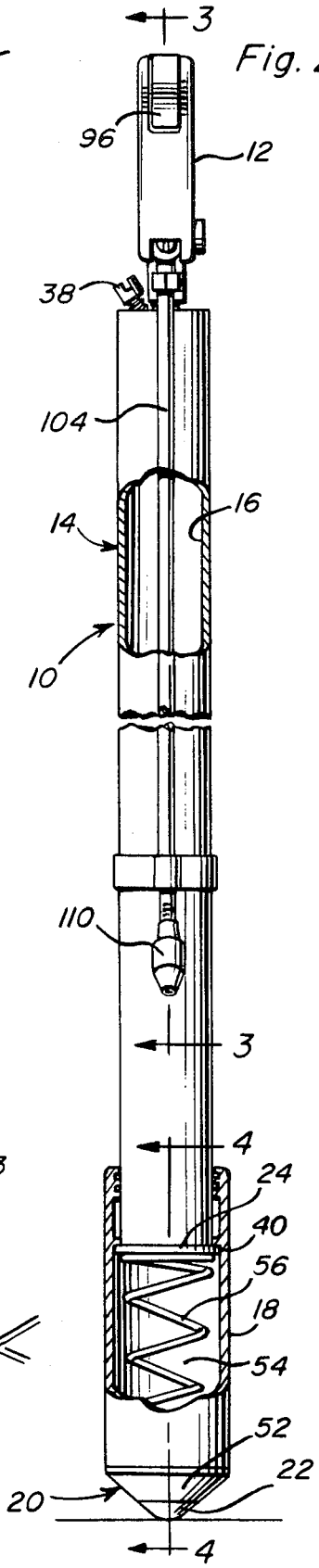
FIG. 2 is a side elevational view thereof in which portions thereof are shown in section.

The handle 12 may be of a closed or open hand-receiving section, FIGS. 1 and 3 showing a closed hand- or finger-receiving section 130 for the handle and the handle may be comprised of one or several die cast or plastic formed components cemented or held in place by screws, rivets and the like. At the distal end of the handle 12 from the hand-grasping portion or section 130, the handle is secured to the neck 70 by a set of roll pins 140.

In summary the air pump tube section may be displaced throughout its modes of compression and expansion a total distance of approximately 3½inches of travel so that air is taken in through the air intake passageway 58 filling the pump tube section 18 with air and downward pressure on the handle repeates the cycle until air pressure is built up in the water reservoir to propel a powerful jet stream of water from the jet spray head when pushing one's thumb down on the lever 96. Pushing the thumb down on this lever pivots the lever causing the valve stem to open the valve 78 to release a flow of water under air pressure which passes the water up into the intake tube through the valve body and the release valve down to the jet spray head through the external tube 104 clamped to the reservoir cylinder 16 by clamp 106. The tube 104 is connected to the valve body 76 by a compression fitting and nut assembly 108 as shown in FIG. 3. This jet or spray head is positioned approximately 9½ inches from the ground and is angled as shown so as to direct a jet spray of water 112 of great force upon and onto the animal excretion matter 114 a short distance away from the liquid power spray disposer apparatus. Air and water retention is maintained by the use of corrosion-resistant ball check valve and O-rings. Parts of the liquid sprayer apparatus and assembly are made of corrosion free metals or plastic materials. This device may be used generally in the nature of a walking cane so that air pressure can be built up in the water reservoir while walking in a normal manner such as when walking a dog so that the device is ready for instant use when the dog or other pet deposits excrement onto a sidewalk or the like with the quantity of water being adequate to break up and flush the excrement into the soil the gutter and into a drain or disperse the excrement into the soil.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A liquid spray device embodied in a walking cane, the cane having an elongate body comprising telescopically mounted spring biased upper and lower sections, the lower section defining a ground engageable lower end of the cane and the upper section defining an upper end of the cane provided with a handle, one of said sections having an internal liquid reservoir and the other of said sections defining internal pumping means for pressurizing liquid in the reservoir, the pumping means being operable by reciprocatory telescopic movement of the sections effected by applying downward pressure on the handle with said ground engageable end of the cane in ground engagement, the device further including downwardly directed nozzle means communicating with the reservoir for receiving liquid under pressure from the reservoir and for releasing the liquid downwardly in the form of a liquid spray to disperse animal droppings and the like, a one-way inlet check valve for admitting air from the pump means to the reservoir, an outlet valve in liquid flow communication between the reservoir and the nozzle means, and manual control means for opening and closing said outlet valve, the arrangment being such that the pump means may be used to build up and store pressure in the reservoir and the outlet valve may be operated to release liquid from the nozzle subsequent to operation of the pump means, wherein the pump means includes a pump chamber formed internally in said lower section of the cane, said chamber incorporating biasing means urging said sections apart, wherein said upper section of the cane defines the liquid reservoir and includes a closure plate at its lower end mounting said inlet valve, a liquid tube having an inlet adjacent said plate, the tube extending upwardly through the reservoir and communicating with said outlet valve, and wherein the outlet valve is located adjacent the handle and the device includes a liquid release tube extending downwardly from the outlet valve adjacent the upper section of the cane, said nozzle being mounted at the lower end of the liquid release tube.

2. The invention of claim 1 wherein the outlet valve includes a valve operating plunger and the control means comprises a thumb-actuated operating lever associated with the handle and connected to said plunger.

3. A liquid spray device embodied in a walking cane, the cane comprising an elongate body with a ground-engageable lower end and an upper end provided with a handle, means defining a liquid reservoir in said body, an air inlet vavle associated with the reservoir for admitting compressed air to the reservoir and pressurizing liquid therein, manually reciprocal pump means in the cane body for supplying compressed air to the reservoir through said inlet valve, the pump means being operable by the application of pressure to the handle of the cane, an outlet valve for releasing liquid under pressure from the reservoir through a liquid release tube, a spray nozzle at the end of said tube, and control means for the outlet valve including a manual actuator associated with the cane handle, the pump means being operable independently of said actuator for building up pressure on liquid in the reservoir and storing the liquid in pressurized form prior to release of the liquid through said outlet valve and nozzle, wherein the outlet valve is adjacent the handle and the liquid release tube extends from the outlet valve down the outside of the cane body to the spray nozzle.

4. The invention of claim 3 wherein the cane body comprises upper and lower telescopically mounted spring-biased sections, the upper section defining the reservoir and the lower section defining an internal pump chamber constituting said pump means, the upper section having a closure plate at its lower end including said inlet valve, and operation of the pump means being effected by reciprocatory telescopic movement of the upper and lower sections produced by applying downward pressure on the cane handle when a lower end of said lower section is in ground engagement.

5. The invention of claim 3 wherein the liquid reservoir includes a liquid tube communicating with the outlet valve and having an inlet adjacent the lower end of the chamber.

6. A liquid spray device embodied in a walking cane, the cane comprising an elongate body with a groundengageable lower end and an upper end provided with a handle, means defining a liquid reservoir in said body, an air inlet valve associated with the reservoir for admitting compressed air to the reservoir and pressurizing liquid therein, manually reciprocable pump means in the cane body for supplying compressed air to the reservoir through said inlet valve, the pump means being operable by the application of pressure to the handle of the cane, an outlet valve for releasing liquid under pressure from the reservoir through a liquid release tube, a spray nozzle at the end of said tube, and control means for the outlet valve including a manual actuator associated with the cane handle, the pump means being operable independently of said actuator for building up pressure on liquid in the reservoir and storing the liquid in pressurized form prior to release of the liquid through said outlet valve and nozzle, wherein the outlet valve includes a valve operating plunger and the actuating means comprises a thumb-operated lever in the handle connected to the plunger.

* * * * *